United States Patent [19]

Hittel

[11] Patent Number: 4,617,934

[45] Date of Patent: Oct. 21, 1986

[54] BRASSIERE FRAME

[75] Inventor: William C. Hittel, New Hyde Park, N.Y.

[73] Assignee: International Playtex, Inc., Stamford, Conn.

[21] Appl. No.: 759,024

[22] Filed: Jul. 25, 1985

[51] Int. Cl.[4] ..... A41C 3/00; A41C 1/14

[52] U.S. Cl. ..... 128/425; 128/476

[58] Field of Search ..... 128/425, 476

[56] References Cited

U.S. PATENT DOCUMENTS 2,506,639 5/1950 Gordon ..... 128/476

2,794,984 6/1957 Astor ..... 128/476

*Primary Examiner*—Doris L. Troutman

*Attorney, Agent, or Firm*—Stewart J. Fried; Charles N. J. Ruggiero

[57] ABSTRACT

There is provided a brassiere frame for use in conjunction with breastcup supports. The brassiere frame includes a front portion, a pair of side panels made of a substantially elastic material, and a pair of breast cups each adjacent the front portion and a different one of the pair of side panels. Each breast cup has an almost perfect U shape configuration and each side panel has a particular pitch so that the brassiere frame provides that breast supporting forces are directed at the base of the breast cups thereby anchoring the brassiere frame and the remaining component forces are transmitted substantially in only one direction.

11 Claims, 5 Drawing Figures

BRASSIERE FRAME

BACKGROUND OF THE INVENTION

1. Field of the Invention

The present invention relates to a frame for a brassiere which includes breastcup supports. More particularly, the present invention relates to an improved brassiere frame for use in conjunction with plastic breastcup undershapers (and metal breastcup underwires), which frame does not readily ride-up the body of the wearer.

2. Description of The Related Art

In a brassiere frame for use with metal breastcup underwires, it has been found that the back end of the underwires, i.e. the end adjacent the underarms of the wearer, applies stress to the underarm areas of the wearer. Further, metal underwires have little resilience and, therefore, readily distort or twist out of shape even after relatively little use by the wearer. This distortion increases the discomfort to the wearer, especially in the wearer's underarm areas.

In an attempt to overcome the problems of stress in the wearer's underarm areas, plastic breastcup supports or undershapers have been developed, such as the plastic undershaper which is the subject of pending U.S. application Ser. No. 634,348, filed July 25, 1984 to William C. Hittel, applicant of the present invention, and Dolores O'Boyle. However, the use of plastic undershapers alone, while perhaps reducing, has not sufficiently reduced the stress in the wearer's underarm areas. Further, simply substituting plastic undershapers for metal underwires has presented problems with respect to supporting the sides of the breasts of a wearer and the balancing of forces in a brassiere frame. Specifically, plastic is a very flexible material and, therefore, it has been found that simply substituting plastic breastcup undershapers for metal breastcup underwires in a brassiere results in lack of support for the sides of the wearer's breasts and an increased application of force or stress being directed to the side and back of the brassiere so that the brassiere spreads or stretches thereby losing its shape. Further, the combination of the stress applied and loss of shape of the back and sides of the brassiere result in the brassiere "riding-up" the body of the wearer during movement of the wearer.

SUMMARY OF THE INVENTION

It is an object of the present invention to provide a brassiere frame for use with plastic breastcup undershapers.

It is another object of the present invention to provide a brassiere frame adapted for use with plastic breastcup undershapers and metal breastcup underwires, which frame does not readily "ride-up" the body of the wearer during movement of the wearer.

It is a further object of the present invention to provide a brassiere frame for use with breastcup supports in which the construction of the frame is such that the breast supporting forces of the frame are applied at the base or bottom of the breast cups of the frame.

It is still a further object of the present invention to provide a brassiere frame for use with breastcup supports which can be either plastic or metal, which frame greatly minimizes the stress in the underarm areas of the wearer.

It is yet a further object of the present invention to provide a brassiere frame for use with breastcup supports in which the components of the brassiere frame work together.

These and other objects of the present invention are provided for by a brassiere frame for use in conjunction with breastcup supports which frame includes a front portion, a pair of side panels made of a substantially elastic material, and a pair of breast cups each adjacent the front portion and a different one of the pair of side panels. Significantly, each breast cup has an almost perfect U-shape configuration and each side panel has the same, particular pitch so that the brassiere frame provides that breast supporting forces are directed at the base of the breast cups thereby anchoring the brassiere frame and that the remaining forces of the components are transmitted substantially in only one direction which is a manner more direct than that found in prior art brassiere frames.

DESCRIPTION OF THE PREFERRED EMBODIMENTS

Figure 1:
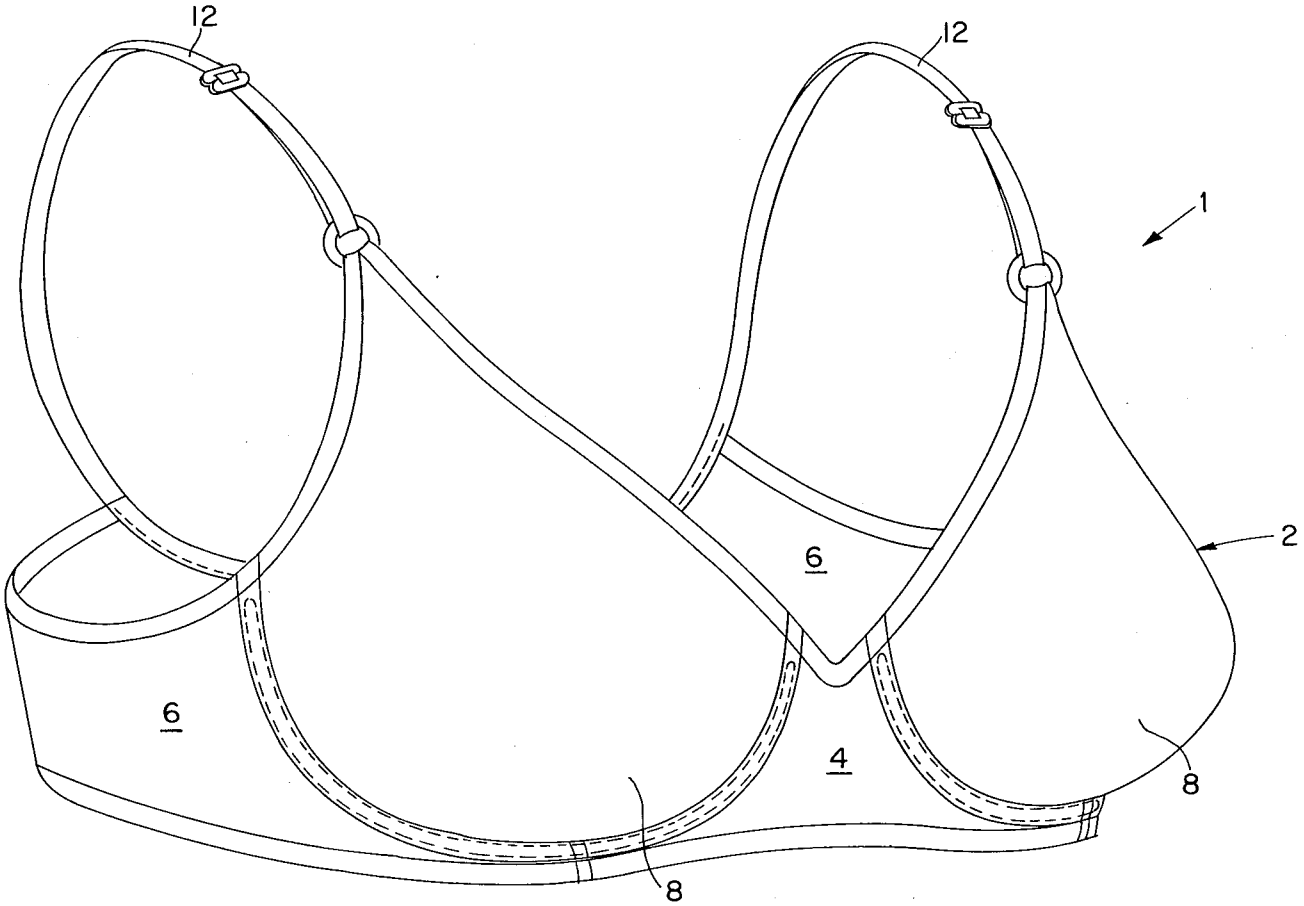
FIG. 1 is a perspective view of a brassiere of the present invention.

Referring to the drawings and, more particularly, to FIG. 1, a brassiere, generally represented by reference numeral 1, includes a frame 2 having a front portion 4, a pair of side or dorsal panels 6, and a pair of breast receiving cups 8 adjacent the front portion and the side panels. The brassiere frame 2 may also include a pair of shoulder straps 12. As shown to FIG. 2, there is provided at the distal ends of the side panels 6, closure means, preferably in the form of a hook 7 and eye 8 arrangement, to fasten the brassiere 1 about the body of a wearer. The brassiere frame 2 also has a pair of material strips 3 each sewn to the front portion 4 and a different one of the pair of side panels 6 so that each strip, the front portion and the respective side panel define an enclosed sheath. Each sheath, which is located along the base and lower portion of both sides of a different one of the pair of breast cups 8, has the configuration of the breast cups and is designed to accommodate therein a breastcup support 20, such as a plastic breastcup undershaper or a metal breastcup underwire.

Figure 2:
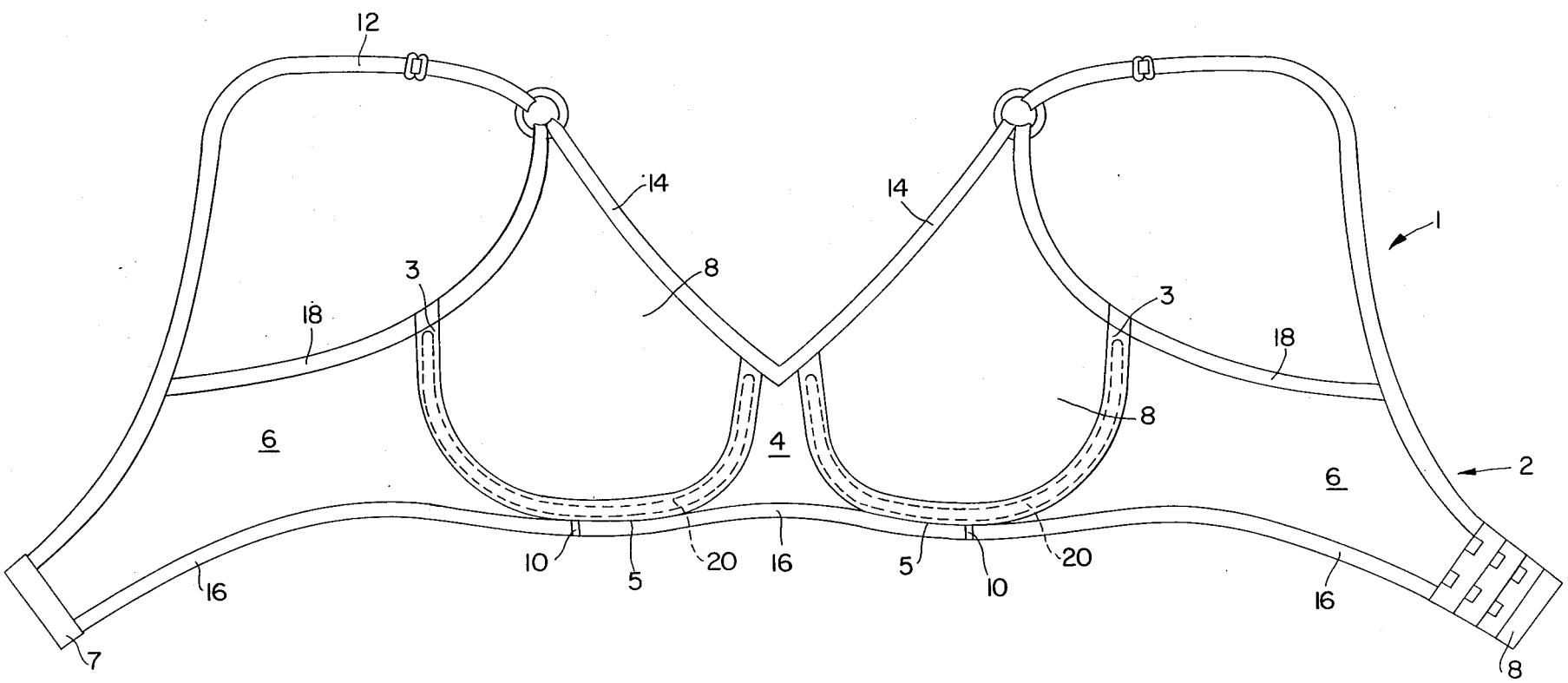
FIG. 2 is a front elevation view of the brassiere of of FIG. 1.

Referring to FIG. 2, the front portion 4 extends vertically downward from the junction of upper marginal edges 14 of the pair of breast cups 8 to and includes a portion of lower marginal edge 16 of the brassiere frame 2. Further, the front portion is positioned substantially between the pair of breast cups 8, yet includes a pair of peripheral edges 5 each located at the junction of one of the pair of side panels 6 and the panel's respective breast cup 8. The entire front panel 4 is made of a rigid material, such as tricot, so that this component of the brassiere remains basically stable, i.e. basically remains in place on the body of the wearer even during the variety of movements of the wearer.

Each side panel 6 extends from and is connected to the breast cup 8, and the edge of each side panel opposite the respective breast cup may be attached to one of the pair of shoulder straps 12. Further, each side panel 6 is connected at its topmost edge to upper marginal edge 18, which is the edge positioned under the arm of the wearer, and extends vertically downward to and includes a portion of lower marginal edge 16 of the brassiere frame 2.

At the lower marginal edge 16, side panel 6 is connected to its respective peripheral edge 5 of the front portion 4, preferably, by overlapping material of the side panel and its respective peripheral edge and joining them together, preferably by sewn stitches, to form region 10. Further, the portion of the lower marginal edge 16 in the side panel 6 has an elastic member therein. Likewise, upper marginal edge 18 has an elastic member therein.

Each side panel 6 is made of a basically elastic material, such as lycra powernet material. This powernet material, when used in a side panel, stretches in both the horizontal and vertical directions, however there is greater stretch in the horizontal direction.

Figure 3:
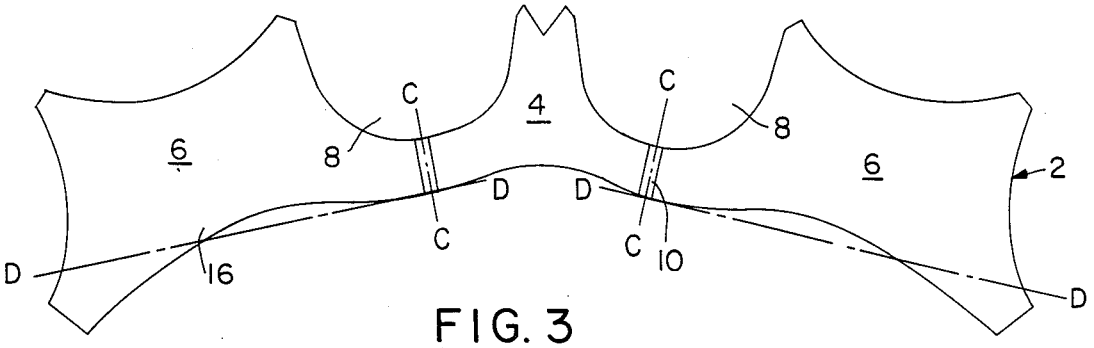
FIG. 3 is an enlarged plan view of the portion of the brassiere of FIG. 2 below line 3—3.

Each breast cup 8 is connected to and located between the front portion 4 and a different one of the pair of side panels 6. The base or bottom of the breast cup 8 may, preferably, be partially embedded in the lower marginal edge 16 where front portion 4 and respective side panel 6 are joined. Significantly, each breast cup has a configuration as shown in FIG. 3, in which the legs or leg portions of the U are almost parallel even though they may be of different lengths. Moreover, the base or bottom or base portion of the U is flat for a relatively signficant extent when compared to the overall length of the U. Accordingly, the U shape of each breast cup 8 has a leg, arc, pronounced flat base, arc and leg construction. Also, the midpoint of the base of the U, preferably, rests on line C—C which is the vertical center of region 10.

It has been found that this specific U-shape configuration and the positioning of the breast cups effects the overall transmission of the remaining, i.e. non-breast supporting, forces of the components of the brassiere frame 2 and the breastcup supports. Specifically, it has been found that due to the flat base of the breast cups 8 relatively all of the breast cup supporting forces or stresses from each component of the frame are directed to the base of the breast cups thereby anchoring the brassiere frame 2 on the body of the wearer. Further, this anchoring removes stress from the top of the breast cups 8, and, if the brassiere frame has shoulder straps, from the shoulder straps. It has also been found that by this anchoring and the configuration of the breast cups 8, the flexibility of the plastic breastcup undershapers (20) in this brassiere frame 2 is restricted. Accordingly, the, heretofore, found stretch in the back and sides of the brassiere caused by plastic undershapers is reduced. Moreover, the legs of the plastic undershapers and the breast cups 8 are now restricted from flexing outward as much as before so that they are positioned more adjacent to the sides of the breasts of the wearer thereby providing better support for the wearer's breasts.

Also, each side panel 6, including its portion of the lower marginal edge 16 of the brassiere frame 2, has a particular pitch. The construction of each side panel 6 also effects the transmission of the remaining, i.e. non-breast supporting, forces of the components, in the brassiere frame and further restricts the flexibility of the plastic breastcup undershapers.

As shown in FIG. 3 which represents the portion of an unworn brassiere of the present invention in its front elevation or flat position, line C—C is the vertical center of region 10 and line D—D is perpendicular to line C—C at the base of region 10. Line D—D represents the diaphragm line of the body of the wearer. The lower marginal edge 16 included in each side panel 6 forms, when viewed from front portion 4, initially a half sinusoidal wave above line D—D and then crosses below line D—D and diverts from line D—D at an increasing acute angle. When measured along line D—D, the sinusoidal wave portion (above line D—D) of lower marginal edge 16 of each side panel 6 is approximately twice as great as the diverting portion (below line D—D) of the lower marginal edge of that side panel.

In the brassiere frame 2 of the present invention, the marginal lower edge 16 of each side panel 6 is on line D—D when the brassiere is on the wearer which means the lower marginal edge of the side panel is on the diaphragm line of the body of the wearer. This brassiere alignment on the body of the wearer has been found to result in a basically direct or horizontal only transmission of the non-breast supporting forces in the brassiere frame and therefore about the wearer's body.

Figure 4:
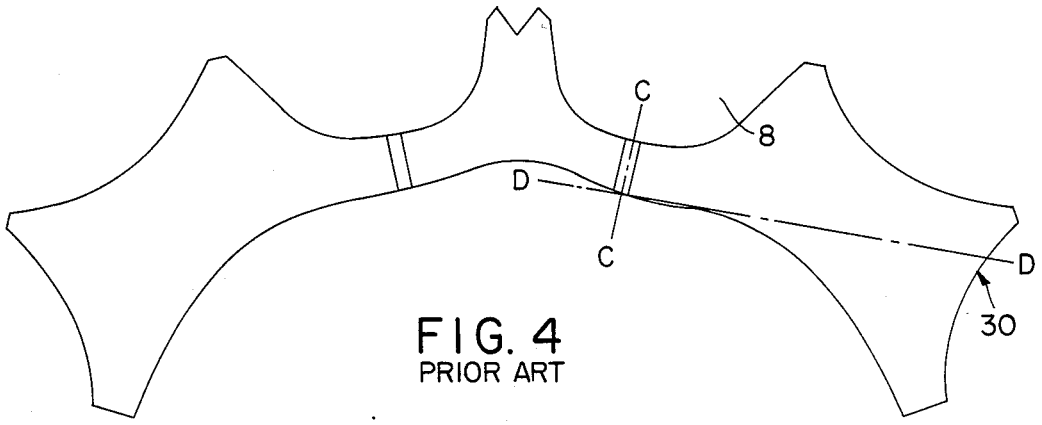
FIG. 4 PRIOR ART
FIG. 4 is an enlarged plan view of the portion of a conventional brassiere analogous to the portion shown in FIG. 3 of the brassiere of the present invention.

As shown in FIG. 4, the corresponding portion 30 of a conventional brassiere, when measured by the line D—D, does not have a sinusoidal portion but instead forms below line D—D an increasing acute angle. Accordingly, this conventional brassiere is not parallel to line D—D, the diaphragm line, when the brassiere is on the wearer so that the brassiere does not provide for the direct transmission of forces in the brassiere frame and therefore about the body of the wearer.

Figure 5:
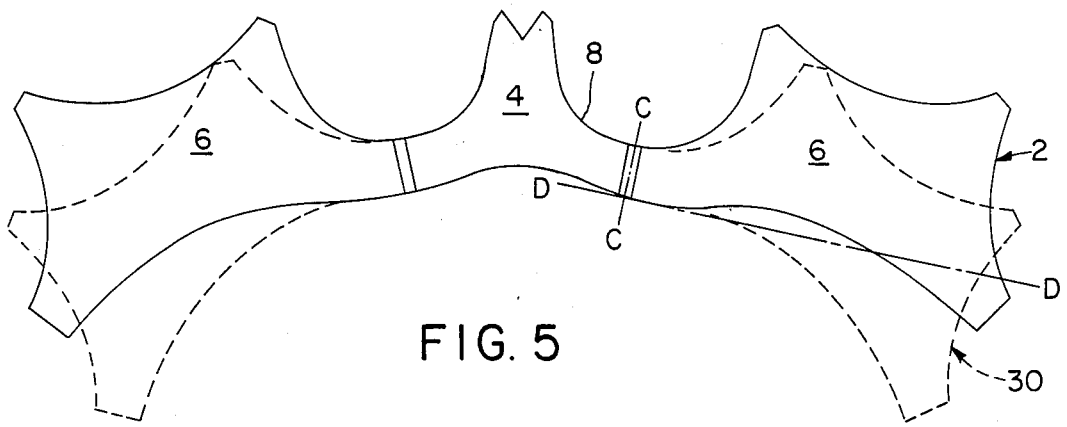
FIG. 5 is a plan view (shown in solid lines) of the portion shown in FIG. 3 of the brassiere of the present invention superimposed on a plan view (shown in dotted lines) of the portion shown in FIG. 4 of a conventional brassiere.

As illustrated in FIG. 5, the particular pitch of side panels 6 of the brassiere frame 2 of the present invention is not nearly so extreme a pitch as that in the conventional brassiere 30. By the particular pitch of side panels 6, it is also found that the stretch at the lower portion of the side panel basically equalizes the stretch at upper portion adjacent that side panel. This results in there being substantially no vertical or diagonal pull, just simply a direct horizontal pull, in the side panel. Further, since the front portion 4 is stable or rigid and the breast cups 8 have a flat base, when force is applied to the breast cups, the legs of each breast cup move slightly away from each other. This movement basically provides horizontal or one directional transmission of non-breast supporting forces in the brassiere frame. Therefore, the side panel 6 and breast cups 8 basically transmit non-breast supporting forces in only one direction. Thus, these components work together to provide a more direct transmission of the remaining (non-breast supporting) forces of brassiere components in the brassiere frame 2.

It has been found, apparently primarily due to the construction of the breast cups 8 and the side panels 6 of brassiere frame 2, probably in conjunction with the front portion 4, that the present brassiere frame when used with plastic breastcup undershapers does not ride-up the body of the wearer or, at least, does not ride-up the body of the wearer as readily as conventional brassieres having breastcup supports. It has also been found, apparently due to the anchoring of the breast support forces at the base of the breast cups 8 and therefore the reduction of stress at the top of the breast cups, breastcup supports, and shoulder straps, that stress or force in the wearer's underarm areas is reduced so much so that metal breastcup underwires can also be used in the subject brassiere frame. Thus, the subject brassiere frame 2 has the additional benefit that, without modification, it can be used with plastic breastcup undershapers and metal breastcup underwires.

Although certain embodiments have been described and illustrated, modification may be made, as by adding, combining, subdividing parts or substituting equivalents while retaining the advantages and benefits of the present invention which is defined in the following claims.

I claim:

1. A brassiere frame for use in conjunction with a pair of breastcup supports, comprising:

a front portion;

a pair of side panels, each of said pair of side panels made of a substantially elastic material, and each of said pair of side panels having a lower marginal edge and being of a particular pitch, whereby the lower marginal edge is basically on the diaphragm line of the body of a wearer when said brassiere frame is on the body of the wearer;

a pair of breast cups, each of said pair of breast cups adjacent and connect to said front portion and a different one of said pair of side panels, each of said pair of breast cups having an almost perfect U shape configuration, wherein said brassiere frame provides for anchoring of breast supporting forces at the base of said pair of breast cups, and for substantially one directional transmission of the non-breast supporting forces in said brassiere frame.

2. The brassiere frame of claim 1, further comprising a pair of shoulder straps each connected to a different one of said pair of side panels.

3. The brassiere frame of claim 1, wherein said front portion is made of a substantially rigid material.

4. The brassiere frame of claim 1, wherein each of said pair of breastcup supports is made of plastic material.

5. The brassiere frame of claim 1, wherein each of said pair of breastcup supports is made of metal.

6. The brassiere frame of claim 1, wherein each of the almost perfect U-shape configurated breast cups has a pair of leg portions which are substantially parallel to each other, and has a base portion which is substantially flat.

7. The brassiere frame of claim 6, wherein said front portion includes a pair of peripheral edges, each edge adapted to override a portion of a different one of said pair of side panels, whereby the overlying portions of one peripheral edge and its respective side panel form a region.

8. The brassiere frame of claim 7, wherein the center of said base portion of each of said breast cups is located approximately at the center of its respective region.

9. The brassiere frame of claim 1, wherein the lower marginal edge of each of said pair of side panels forms, from said front portion, first a half sinusoidal wave above the diaphragm line and then crosses below the diaphragm line and continues at an increasing acute angle away from the diaphragm line when said brassiere frame is unworn, and wherein the half sinusoidal wave portion of the lower marginal edge is approximately twice as great as the acute angle portion of the lower marginal edge when measured along the diaphragm line.

10. A brassiere frame for use in conjunction with a pair of breastcup supports, comprising:

a front portion made of substantially rigid material and having a pair of peripheral edges;

a pair of side panels, each of said pair of side panels made of a substantially elastic material, and each of said pair of panels having a lower marginal edge and being of a particular pitch, whereby the lower marginal edge is basically on the diaphragm line of the body of a wearer when said brassiere frame is on the body of the wearer, and whereby the lower marginal edge forms, from said front portion, first a half sinusoidal wave above the diaphragm line and then crosses below the diaphragm line and continues at an increasing acute angle away from the diaphragm line when the brassiere is unworn, wherein each peripheral edge is adapted to override a portion of a different one of said pair of side panels so that the overlying portions of one peripheral edge and its respective side panel form a region, a pair of breast cups, each of said pair of breast cups adjacent and connect to said front portion and a different one of said pair of side panels with the center of the base portion being located approximately at the center of its respective region, each breast cup having an almost perfect U shape configuration which includes having a pair of leg portions which are substantially parallel to each other, a substantially flat base portion, and a pair of arc portions each connecting a different one of the pair of leg portions to the base portion, wherein said brassiere frame provides for anchoring of breast supporting forces at the base of said pair of breast cups, and for substantially one directional transmission of the non-breast supporting forces in said brassiere frame.

11. The brassiere frame of claim 10, further comprising a pair of shoulder straps each connected to a different one of said pair of side panels.

* * * * *